US007121174B2

(12) United States Patent
Lai et al.

(10) Patent No.: US 7,121,174 B2
(45) Date of Patent: Oct. 17, 2006

(54) SCREW-FEEDING DEVICE FOR A SCREW-DRIVING TOOL

(75) Inventors: Chun Chih Lai, Taichung (TW); Shin Nan Chang, Taichung (TW); Hsu Psung Min, Taichung (TW)

(73) Assignee: Basso Industry Corp., Taichung (TW)

( * ) Notice: Subject to any disclaimer, the term of this patent is extended or adjusted under 35 U.S.C. 154(b) by 43 days.

(21) Appl. No.: 11/001,394

(22) Filed: Dec. 1, 2004

(65) Prior Publication Data

US 2006/0112794 A1 Jun. 1, 2006

(51) Int. Cl.
*B25B 23/04* (2006.01)
*B25B 23/06* (2006.01)

(52) U.S. Cl. ..... 81/434; 81/57.37

(58) Field of Classification Search ..... 81/434, 81/435, 57.37
See application file for complete search history.

(56) References Cited

U.S. PATENT DOCUMENTS 5,083,483 A * 1/1992 Takagi ..... 81/434
5,671,645 A * 9/1997 Murayama et al. ..... 81/434
5,899,126 A * 5/1999 Fujiyama et al. ..... 81/434
5,904,079 A * 5/1999 Tsuge et al. ..... 81/434
5,988,025 A * 11/1999 Sasaki et al. ..... 81/434
6,073,523 A * 6/2000 Shinjo ..... 81/434
6,296,166 B1 * 10/2001 Huang ..... 227/119
6,701,811 B1 * 3/2004 Chang et al. ..... 81/434
2004/0112183 A1 * 6/2004 Huang et al. ..... 81/434

* cited by examiner

*Primary Examiner*—David B. Thomas
(74) *Attorney, Agent, or Firm*—Charles E. Baxley

(57) ABSTRACT

The present invention relates to a screw-feeding device for a screw-driving tool comprising: a housing; a belt carrier is rotatably disposed in the housing and provided on the outer periphery with a plurality of teeth; a motion-transmitting member is disposed in the housing for driving the belt carrier to rotate unidirectionally; a guide rod assembly having a first free engaged with the motion-transmitting member and having a second free end used to rotate the motion-transmitting member; a positioning assembly pivotally is disposed in the housing for positioning the motion-transmitting member. The screw-feeding device is not only capable of feeding the screws precisely into the firing position, but also can hold the screws firmly.

3 Claims, 13 Drawing Sheets

SCREW-FEEDING DEVICE FOR A SCREW-DRIVING TOOL

BACKGROUND OF THE INVENTION

1. Field of the Invention

The present invention relates to a screw-driving tool, and more particularly to a screw-feeding device for a screw-driving tool.

2. Description of the Prior Arts

With reference to FIGS. 1 and 2, a conventional screw-feeding device for a screw-driving tool is shown and includes a housing 10 and a belt carrier 11 disposed in the housing 10. The belt carrier 11 is provided on its outer periphery with a plurality of teeth 111 which are used to carry the strip screws 15. A unidirectional bearing 12 is disposed in the belt carrier 11 and rotated by a guide rod 13, and the unidirectional bearing 12 serves to rotate the belt carrier 11 so that the strip screws 15 can be fed automatically. At each time the belt carrier 11 is rotated a full stroke angle by the unidirectional bearing 12, the arc end 141 of the elastic piece 14 will engage in the notch 112, so that thee belt carrier 11 is positioned and the screws can be screwed into the object. Due to the unidirectional bearing 12, the belt carrier 11 only can rotate unidirectionally, and thus, the screws can be fed automatically. However, this conventional screw-feeding device still has some defects:

First, if the guide rod 13 is unable to rotate a full stroke angle due to the screw-feeding device is being used improperly, since the belt carrier 11 is indirectly driven by the guide rod 13 through the unidirectional bearing 12, the belt carrier 11 will be unable to feed the screws into the firing positing. When the guide rod 13 moves back to its start position, the belt carrier 11 will not be rotated due to the unidirectional bearing 12, so that the screws 15 will still stay in original start position but not in the firing position. At this moment, the screws cannot be fired.

Second, the belt carrier 11 is positioned by the elastic piece 14, however, the elastic piece 14 will be fatigued after a certain period of use, and consequently the belt carrier 11 may be over-rotated since it cannot be positioned precisely by the elastic piece. As a result, the screws 15 cannot be desirably fed into the firing position.

The present invention has arisen to mitigate and/or obviate the afore-described disadvantages.

SUMMARY OF THE INVENTION

The primary objective of the present invention is to provide a screw-feeding device for a screw-driving tool capable of precisely feeding the screws into the firing position.

The secondary objective of the present invention is to provide a screw-feeding device for a screw-driving tool capable of holding the screws firmly.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
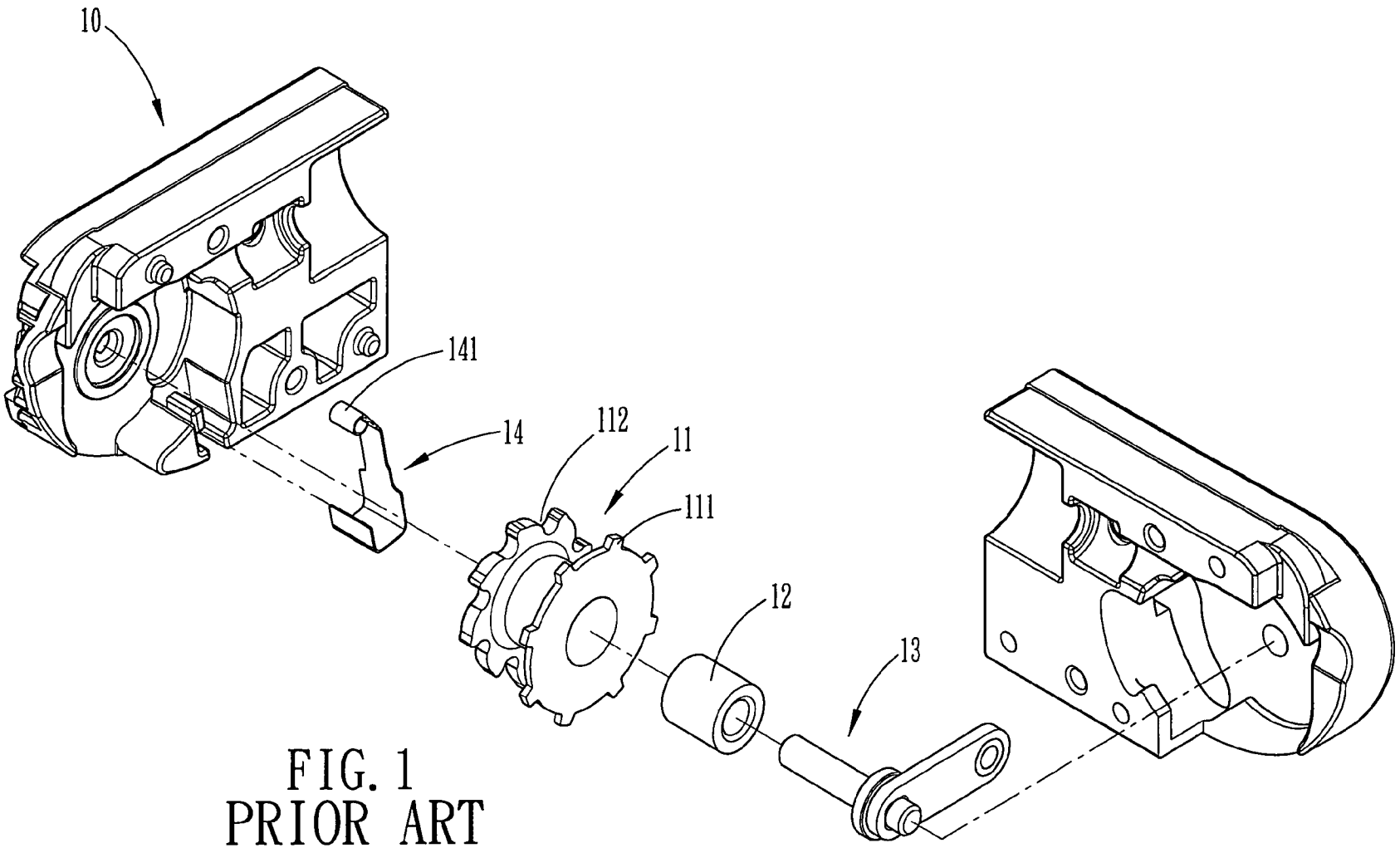
FIG. 1 PRIOR ART
FIG. 1 is an exploded view of a screw-feeding device in accordance with the present invention.
Figure 2:
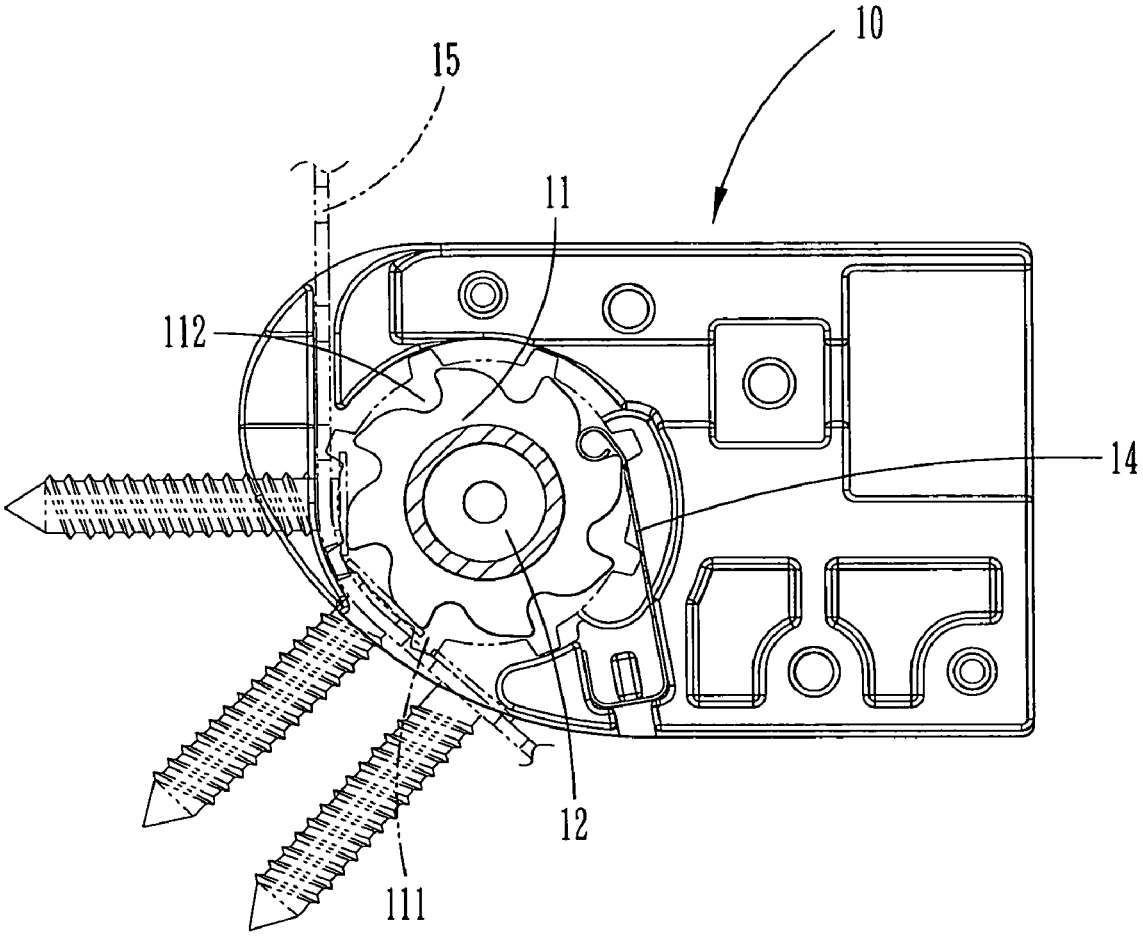
FIG. 2 PRIOR ART
FIG. 2 is a cross sectional view of the screw-feeding device in accordance with the present invention.
Figure 3:
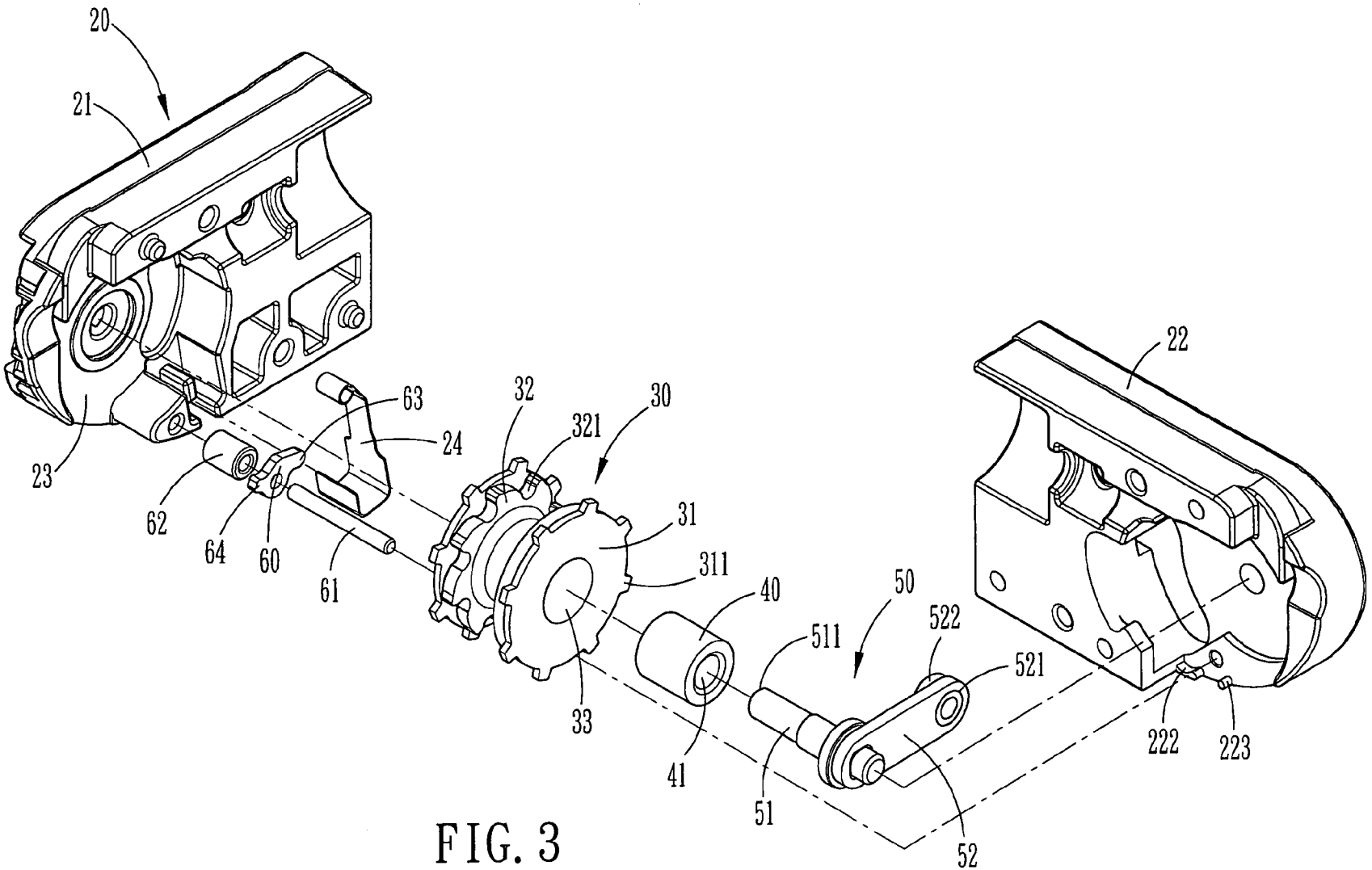
FIG. 3 is an exploded view of the screw-feeding device in accordance with a first embodiment of the present invention.
Figure 4:
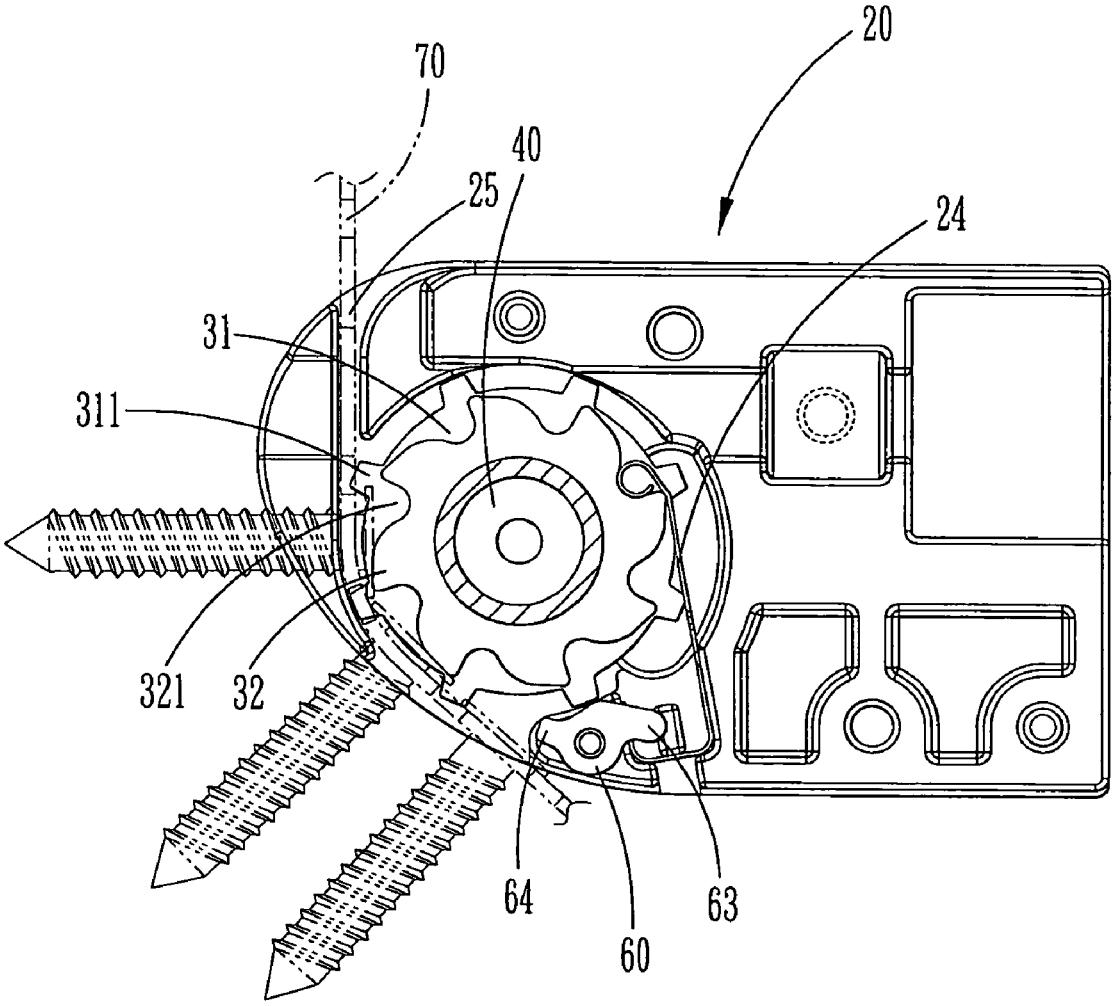
FIG. 4 is a cross sectional view of the screw-feeding device in accordance with the first embodiment of the present invention.
Figure 5:
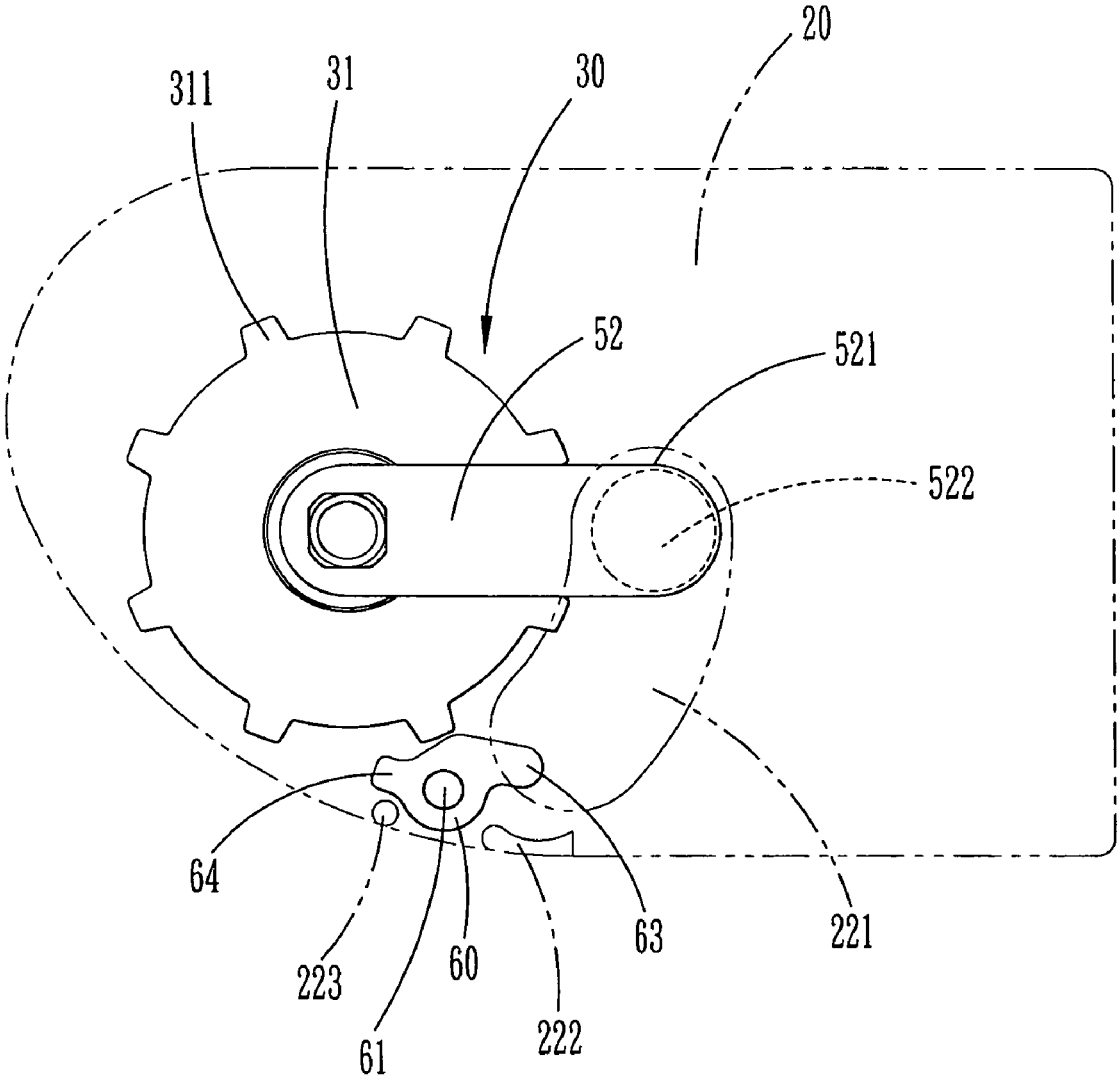
FIG. 5 is side view of the screw-feeding device in accordance with the first embodiment of the present invention.
Figure 6:
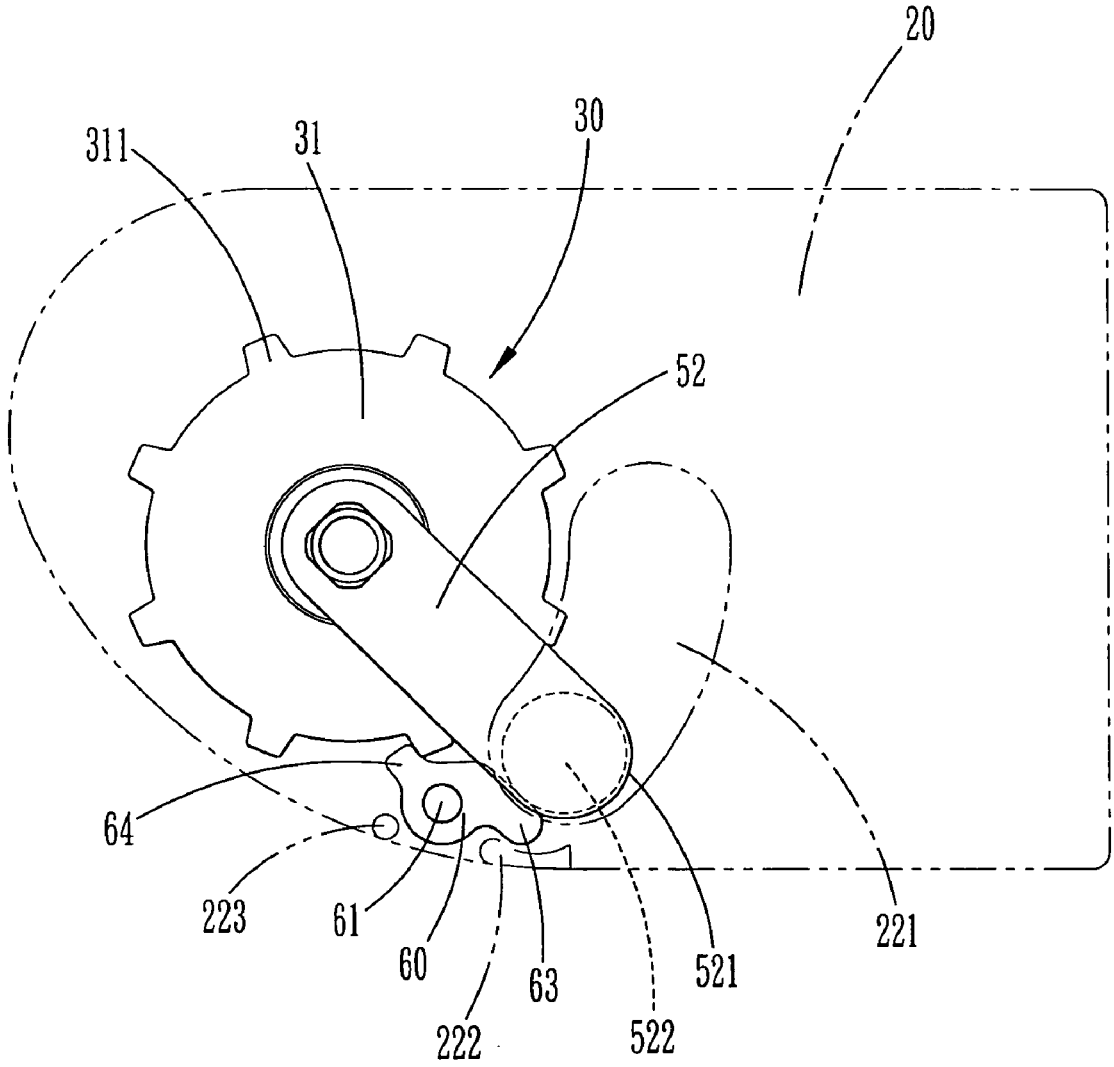
FIG. 6 is an operational view of the screw-feeding device in accordance with the first embodiment of the present invention.
Figure 7:
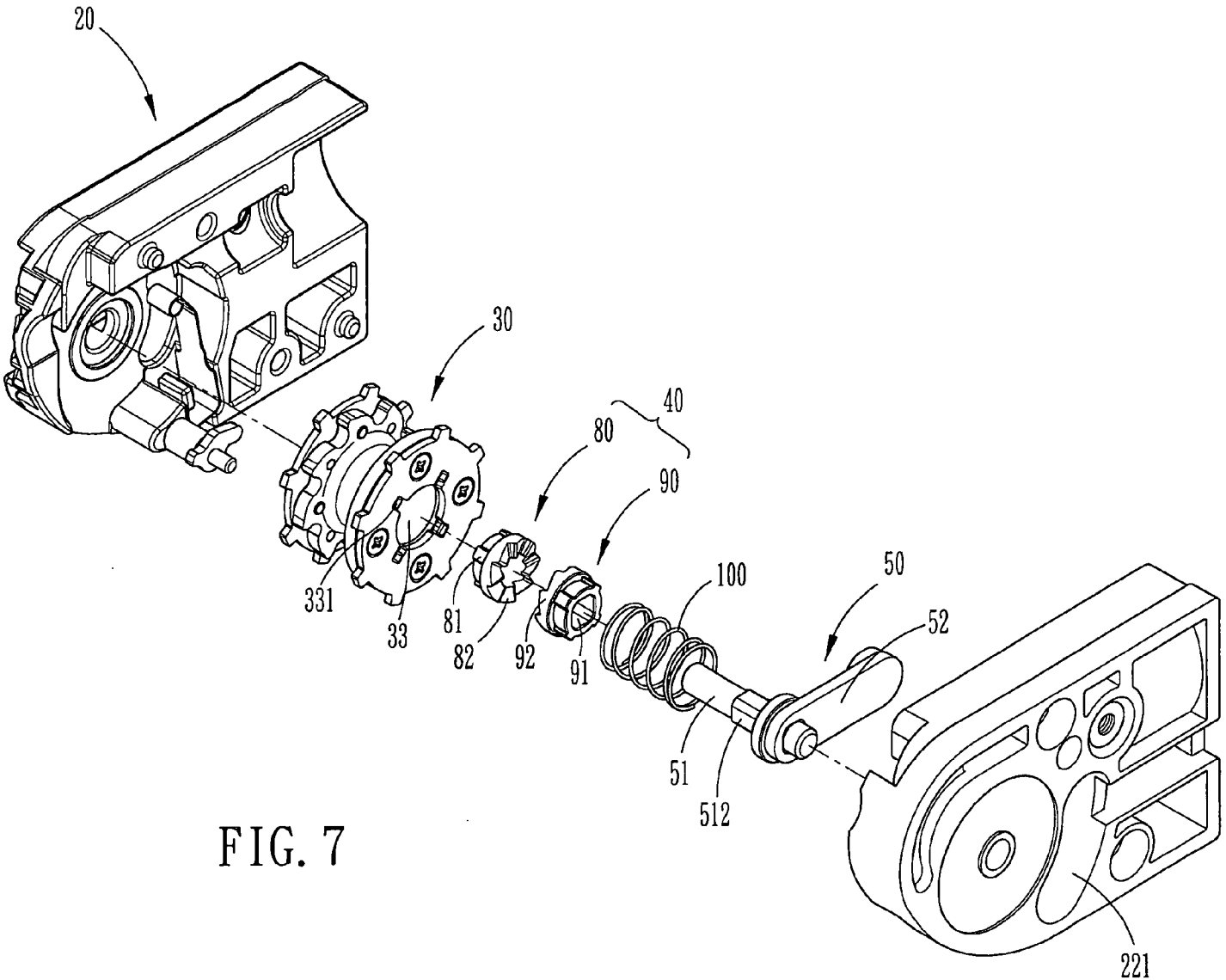
FIG. 7 is an exploded view of a screw-feeding device in accordance with a second embodiment of the present invention.
Figure 8:
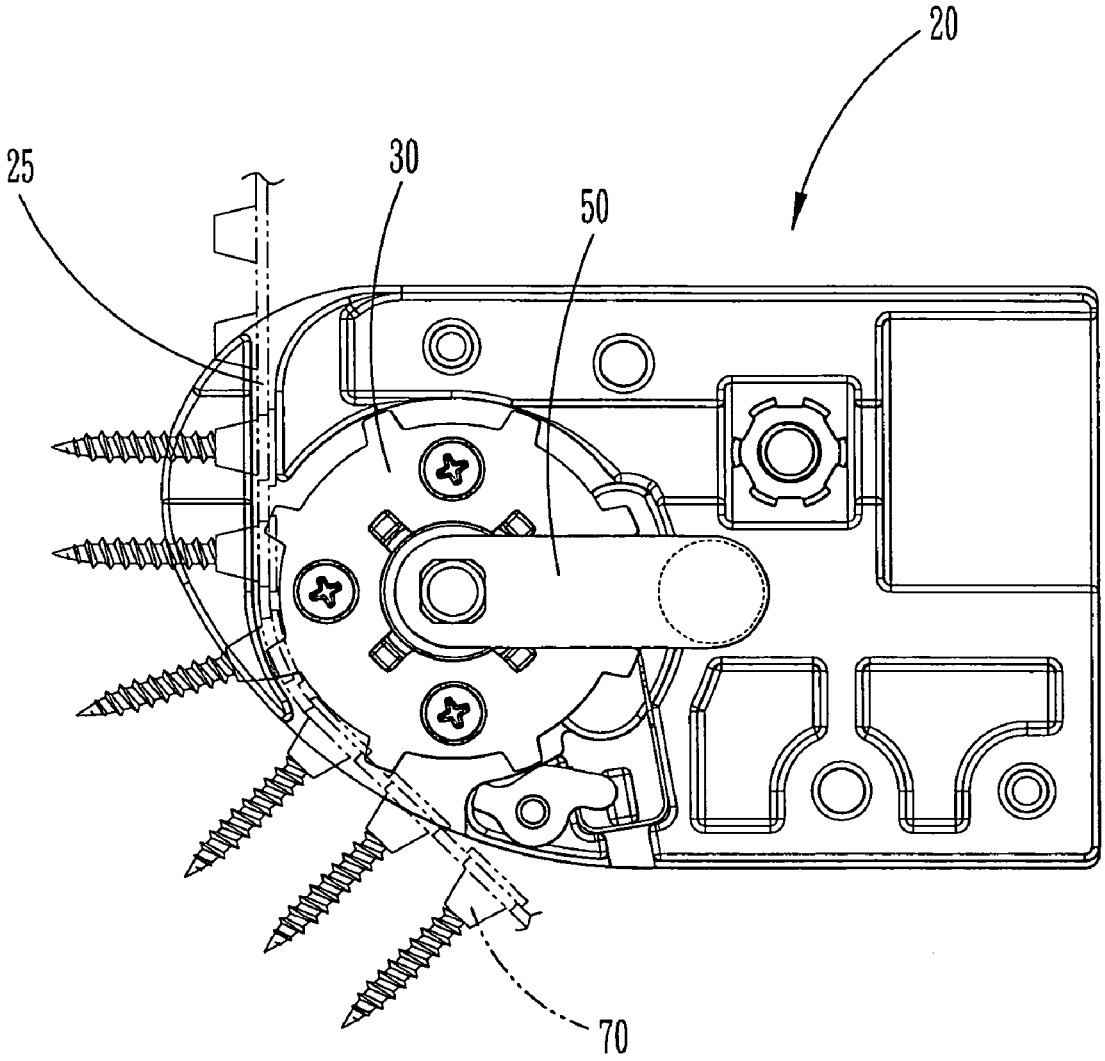
FIG. 8 is a side view of the screw-feeding device in accordance with a second embodiment of the present invention.

Referring to FIGS. 3–5, a screw-feeding device for screw-driving tool in accordance with a first preferred embodiment of the present invention includes: a housing 20, a belt carrier 30, a motion-transmitting member 40, a guide rod assembly 50 and a positioning assembly 60.

The housing 20 includes a male part 21, a female part 22 and a space 23 defined between the male and the female parts 21, 22. In the space 23 is disposed an elastic member 24, at the conjunction between the male and the female parts 21, 22 is formed a feeding passage 25 connected to the space 23, and at a side of the female part 22 is provided with a arch-shaped hole 221 connected to the space 23, a protrusion 222 and a positioning pin 223.

The belt carrier 30 has two driving portions 31 and a positioning portion 32 defined between the two driving portions 31. Each of the driving portions 31 is provided on its outer periphery with a plurality of teeth 311, on the outer periphery of the positioning portion 32 are defined a plurality of positioning cavities 321. The belt carrier 30 is axially provided at the center thereof with a receiving hole 33, and then the belt carrier 30 is rotatably disposed in the space 23 of the housing 20 in such a manner that the positioning cavities 321 of the positioning portion 32 is engaged with the elastic member 24, while some of the teeth 311 partially extends into the feeding passage 25 of the housing 20.

The motion-transmitting member 40 is centrally defined with an inserting hole 41 and disposed in the receiving hole 33 of the belt carrier 30 so as to rotate the belt carrier 30 unidirectionally.

The guide rod assembly 50 includes a first rod 51 and a second rod 52 which are connected together. The first rod 51 and the second rod 52 each has a free end 511, 521. The free end 521 of the second rod 52 is provided with a boss 522.

The first rod 51 is inserted into the inserting hole 41 of the motion-transmitting member 40 while the free end 521 of the second rod 52 moves reciprocally within the arc-shaped hole 221 of the housing 20.

The positioning assembly 60 comprises a bolt 61 and a sleeve 62 which are pivotally installed in the housing 20, the positioning assembly 60 further comprises a first positioning part 63 and a second positioning part 64 which are located opposite to the protrusion 222 and the positioning pin 223 of the housing 20, respectively. The first positioning part 63 is driven by the boss 522 of the free end 521 of the guide rod assembly 50 so that the second positioning part 64 is caused to engage with the teeth 311 of the belt carrier 30.

The strip screws 70 are fed through the feeding passage 25 of the housing 20 and engaged with the teeth 311 of the driving portion 31 of the belt carrier 30. When the free end 521 of the second rod 52 is rotated clockwise a stroke angle, the first rod 51, the motion-transmitting member 40 and the belt carrier 30 will be rotated a stroke angle too, so that the belt carrier 30 will feed the strip screws 70 into the firing position, and thus the screw can be fired.

When the free end 521 of the second rod 52 rotates clockwise to the lowest position, the boss 522 will abut against the first positioning part 63 of the positioning assembly 60, and the positioning assembly 60 will rotate clockwise a stroke angle about the bolt 61, so as to enable the second positioning part 64 abut against the driving portion 31 of the belt carrier 30. Through this way, the belt carrier 30 will be positioned by the positioning assembly 60 after feeding the screws 70 into firing position, so that the screws 70 can optimally positioned.

It is to be noted that the protrusion 222 and the positioning pin 223 are provided in the housing 20 and located opposite to the first and the second positioning parts 63, 64 of the positioning assembly 60, so that the protrusion 222 and the positioning pin 223 can be used to prevent the positioning assembly 60 from being overly rotated.

Referring to FIGS. 7–10, a screw-feeding device for screw-driving tool in accordance with a second preferred embodiment of the present invention also includes: a housing 20, a belt carrier 30, a motion-transmitting member 40 and a guide rod assembly 50. The screw-feeding device for screw-driving tool of this embodiment is generally similar with that of the first embodiment, so the similarities are omitted here, and the differences will be explained as follows:

The belt carrier 30 is axially at the center thereof with a receiving hole 33, and on the internal surface of the receiving hole 33 are formed with a plurality of cavities 331.

The motion-transmitting member 40 includes an engaging block 80 and a driving block 90.

The engaging block 80 is provided at an end with a plurality of projections 81, and at another end of the engaging block 80 are annularly provided a plurality of teeth 82. Each of the teeth 82 includes a bevel surface 821 and an abutting surface 822. The projections 81 of the engaging block 80 are integrally engaged with the cavities 331 of the belt carrier 30.

The driving block 90 is centrally provided with a rectangular hole 91, at an end surface of the driving block 90 are formed a plurality of teeth 92 each of which has a bevel surface 921 and an abutting surface 922. The teeth 92 are engaged with the teeth 82 of the engaging block 80, so that the driving block 90 will drive the engaging block 80 to rotate unidirectionally.

The guide rod assembly 50 includes a first rod 51 connected with a second rod 52. The first rod 51 is provided with a rectangular engaging portion 512 to be inserted in the rectangular hole 91 of the driving block 90.

A spring is biased between the driving block 90 of the motion-transmitting portion 40 and the first rod 51 of the guide rod assembly 50, so as to keep the driving block 90 being engaged with the engaging block 80.

Figure 9:
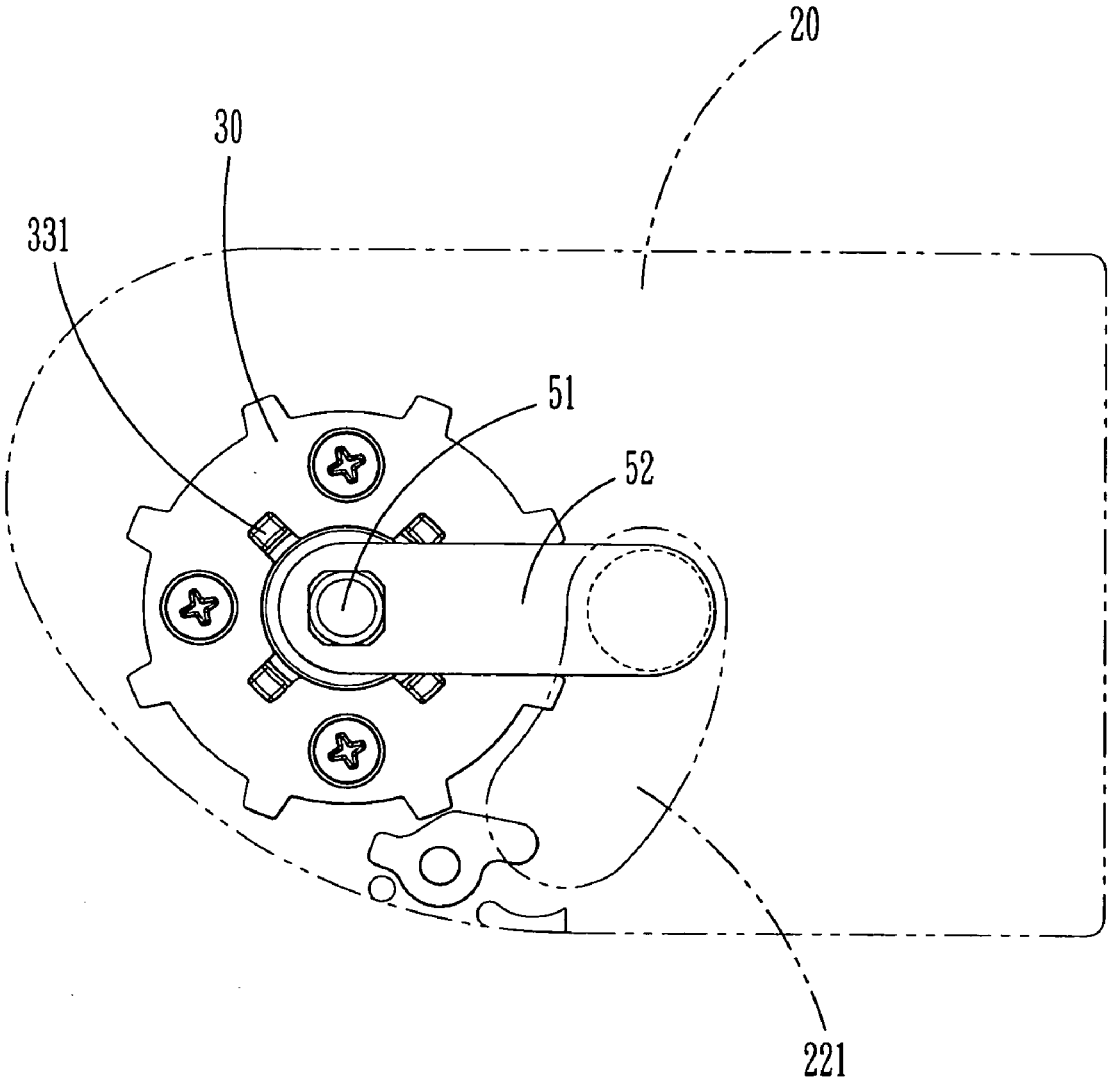
FIG. 9 is an operational view of the screw-feeding device in accordance with a second embodiment of the present invention.
Figure 10:
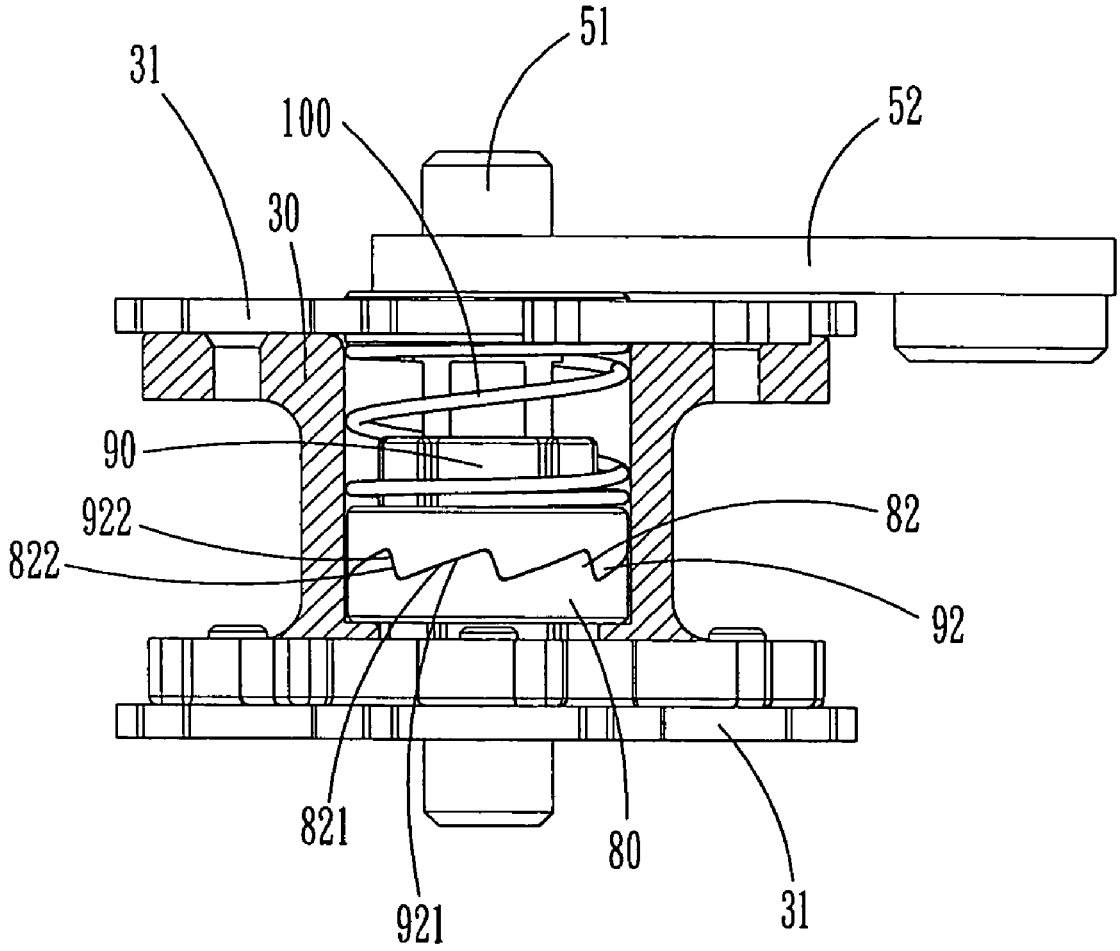
FIG. 10 is another side view of the screw-feeding device in accordance with a second embodiment of the present invention.
Figure 11:
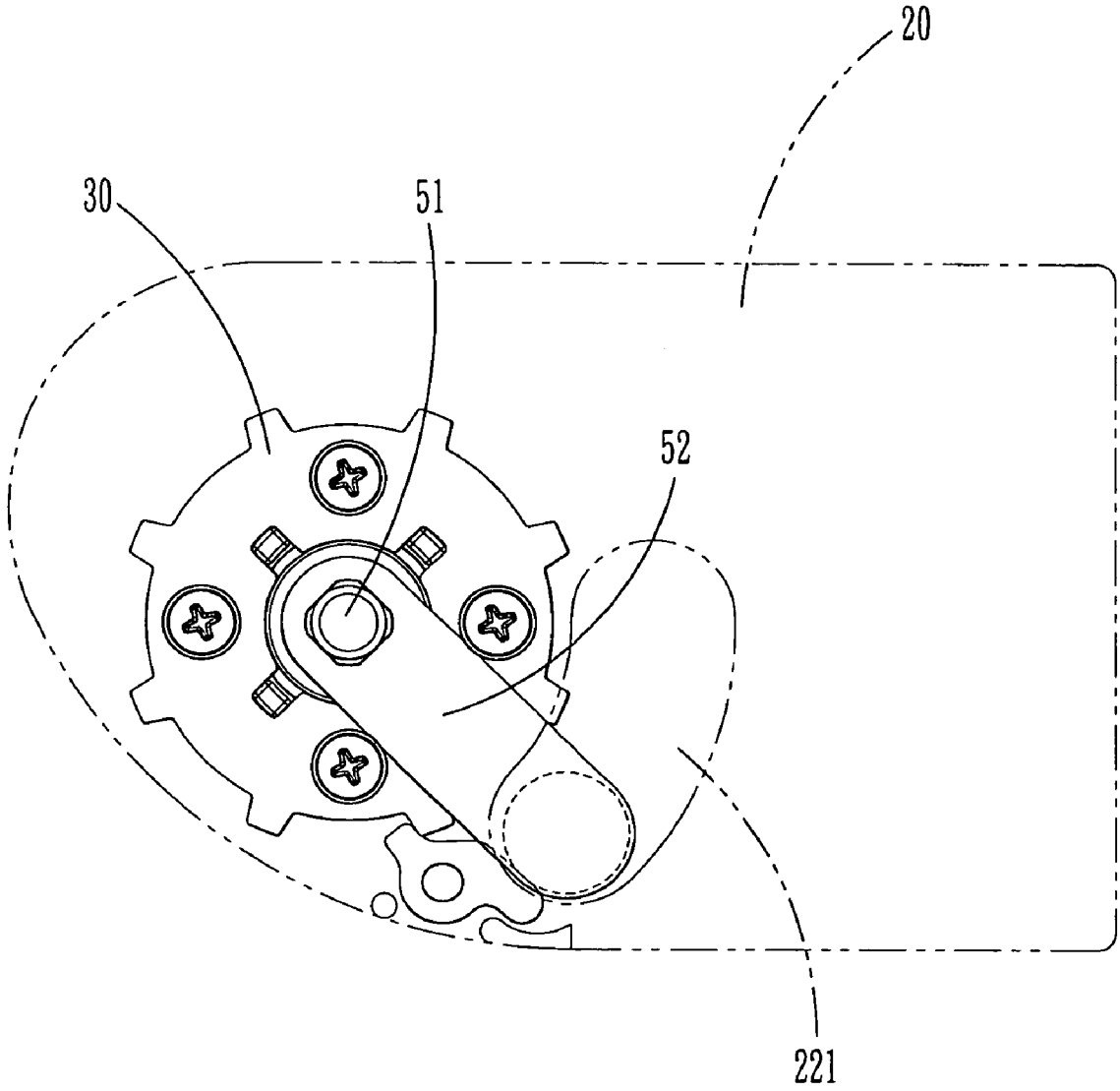
FIG. 11 shows the guide rod assembly is being rotated clockwise.

Referring further to FIGS. 9–11, the strip screws 70 are fed into the housing 20 through the feeding passage 25 and then engaged with the teeth 311 of the driving portion 31 of the belt carrier 30. When the second rod 52 rotates clockwise a stroke angle, the first rod 51 will be rotated a stroke angle too. Due to the first rod 51 is engaged with the driving block 90, the driving block 90 also will be rotated a stroke angle. Furthermore, the teeth 92 of the driving block 90 are engaged with the teeth 82 of the engaging block 80, and the abutting surfaces 822, 922 of the teeth 82, 92 are vertically engaged with each other, as shown in FIG. 10, so that the engaging block 80 will be driven by the driving block 90 to rotate the belt carrier 30 in a clockwise direction. Consequently, the belt carrier 30 will feed the screws 70 automatically into firing position.

Figure 12:
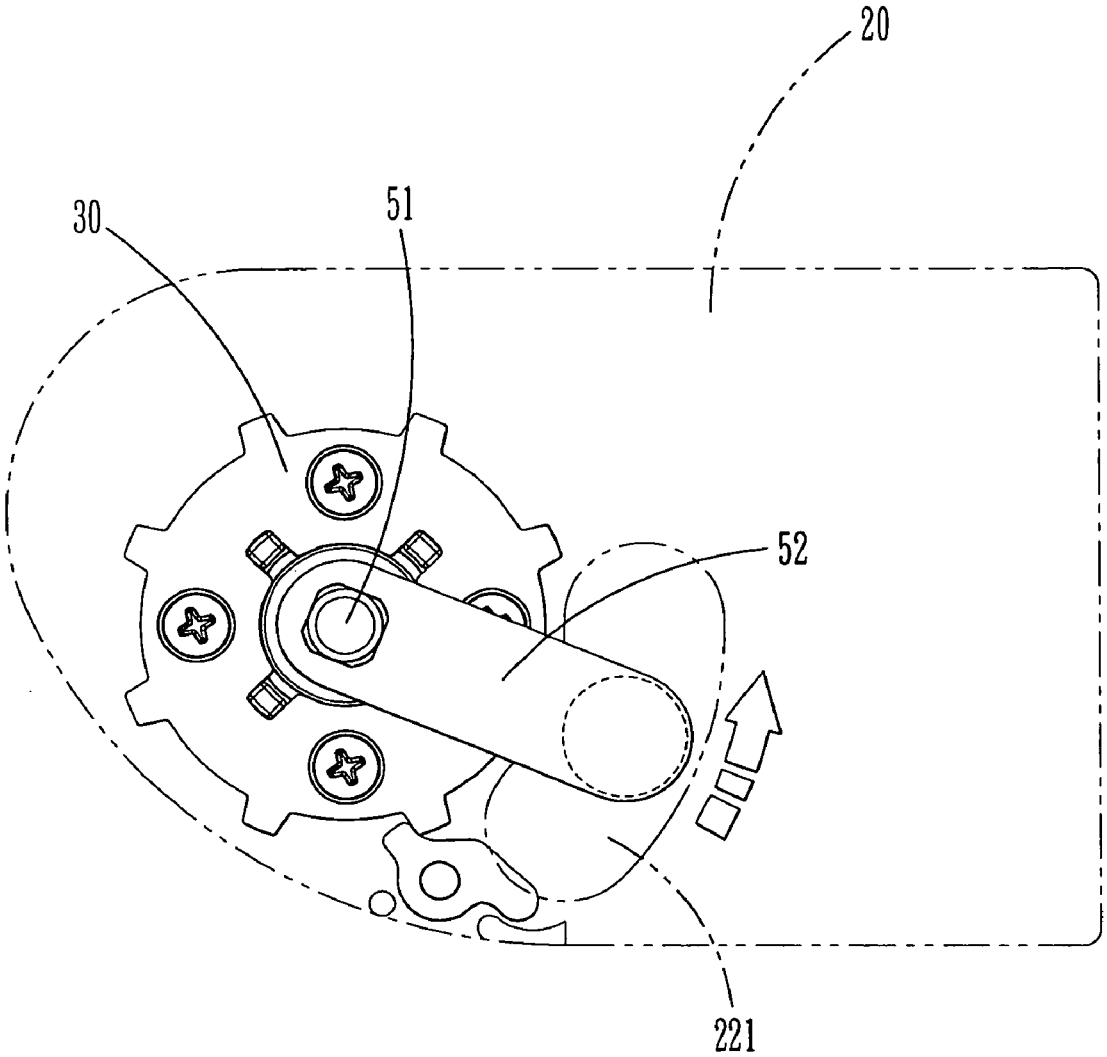
FIG. 12 shows the guide rod assembly is being rotated counterclockwise.
Figure 13:
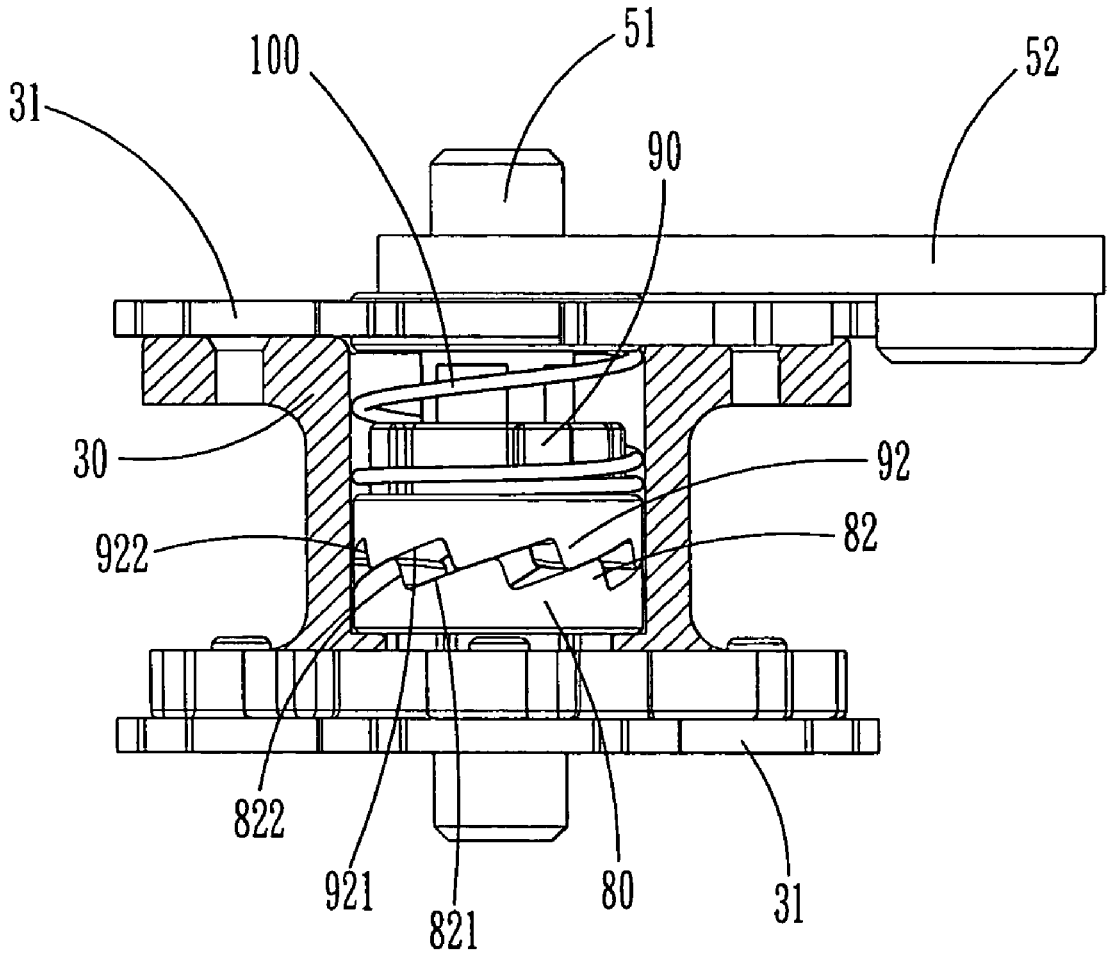
FIG. 13 is another side view of the screw-feeding device of FIG. 12.

After the screw is screwed into an object, the second rod 52 will be rotated counterclockwise a stroke angle, and the first rod 51 and the driving block 90 will be caused to rotate counterclockwise a stroke angle. Since the teeth 82, 92 of the engaging block 80 and the driving block 90 are engaged with each other slantingly, that is, the bevel surfaces 821, 921 as shown in FIGS. 12, 13. When the driving block 90 rotates counterclockwise, the bevel surfaces 921 of the teeth 92 will slide on the bevel surfaces 821 of the teeth 82 of the engaging block 80, that is, when the second rod 52 rotates counterclockwise for returning to the start position, the driving block 90 will be rotated idly relative to the engaging block 80. In this case, the engaging block 80 and the belt carrier 30 will not be rotated. The driving block 90 only can make the belt carrier 30 rotate unidirectionally, so that the screws 70 can be fed automatically into the firing position by the screw-feeding device.

It is to be noted that if the guide rod assembly 50 is unable to rotate a full stroke angle due to the screw-feeding device is used improperly, at this moment, the guide rod assembly 50 is unable to feed the screws 70 to the firing position. However, when the guide rod assembly 50 rotates back to the start position, the engaging block 80 is not fully engaged with the driving block 90, as shown in FIG. 13. Since the spring 100 is biased between the engaging block 80 and the driving block 90, the driving block 90 will be pushed by the spring 100 to move against the teeth 82 of the engaging block 80, furthermore, the guide rod assembly 50 will be positioned after rotating counterclockwise to the start position. At this movement, the driving block 90 is unable to rotate while the engaging block 80 slides on the bevel surfaces 921 of the driving block 90 until it engages with the driving block 90, and thus the screws 70 are positioned precisely into the firing position.

While we have shown and described various embodiments in accordance with the present invention, it should be clear to those skilled in the art that further embodiments may be made without departing from the scope of the present invention.

What is claimed is:

1. A screw-feeding device for a screw-driving tool comprising:

a housing;

a belt carrier rotatably disposed in the housing and provided on outer periphery thereof with a plurality of teeth for carrying strip screws;

a motion-transmitting member disposed in the housing for driving the belt carrier to rotate unidrectionally;

a guide rod assembly having a first free end and a second free end, the first free end engaged with the motion-transmitting member, while the second free end being controlled to move reciprocally so as to rotate the motion-transmitting member;

a positioning assembly pivotally disposed in the housing and including a first positioning part and a second positioning part, wherein the first positioning part is moved by the second free end of the guide rod assembly so as to enable the second positioning part to be engaged with the teeth of the belt carrier;

a positioning pin is formed in the housing and used to abut against the second positioning part of the positioning assembly so as to prevent the positioning assembly from being overly rotated.

2. A screw-feeding device for a screw-driving tool comprising:

a housing;

a belt carrier rotatably disposed in the housing and provided on outer periphery thereof with a plurality of teeth for carrying strip screws;

an engaging block mutually engaged with the belt carrier, at an end surface of the engaging block formed a plurality of teeth;

a driving block provided at an end surface thereof with a plurality of teeth employed to be engaged with the teeth of the engaging block, the driving bock serves to drive the engaging block to rotate unidirectionally;

a guide rod assembly, a first end of which engaged with the driving block, a second end of the guide rod assembly being controlled to move reciprocally so as to rotate a motion-transmitting member;

a spring biased between the driving block and the guide rod assembly so as to keep the driving block being engaged with the engaging block;

wherein the belt carrier is centrally provided with a receiving hole which is formed on the internal surface thereof with a plurality of cavities, the engaging block is provided with a plurality of projections which are engaged with the cavities of the belt carrier.

3. The screw-feeding device for a screw-driving tool as claimed in claim 2, wherein the driving block is centrally provided with a rectangular hole, the guide rod assembly includes a first rod connected to a second rod, the first rod is provided with a rectangular engaging portion which is to be engaged with the rectangular hole of the driving block.

* * * * *